US010434636B2

(12) United States Patent
Wang

(10) Patent No.: US 10,434,636 B2
(45) Date of Patent: Oct. 8, 2019

(54) PUSH-PULL BIT DETACHING AND MOUNTING TOOL

(71) Applicant: Shaoxing Huanzhou Tools Co., Ltd, Zhejiang (CN)

(72) Inventor: Boyong Wang, Zhejiang (CN)

(73) Assignee: SHAOXING HUANZHOU TOOLS CO., LTD, Shaoxing, Zhejiang Province, Zhejiang (CN)

( * ) Notice: Subject to any disclaimer, the term of this patent is extended or adjusted under 35 U.S.C. 154(b) by 129 days.

(21) Appl. No.: 14/891,530

(22) PCT Filed: Nov. 11, 2014

(86) PCT No.: PCT/CN2014/090773
§ 371 (c)(1),
(2) Date: Jul. 3, 2017

(87) PCT Pub. No.: WO2016/065670
PCT Pub. Date: May 6, 2016

(65) Prior Publication Data

US 2017/0348845 A1 Dec. 7, 2017

(30) Foreign Application Priority Data

Oct. 27, 2014 (CN) ..... 2014 1 0581397

(51) Int. Cl.
*B25B 21/00* (2006.01)
*B25G 1/08* (2006.01)
(Continued)

(52) U.S. Cl.
CPC ..... *B25G 1/085* (2013.01); *B25B 15/04* (2013.01); *B25B 21/00* (2013.01);
(Continued)

(58) Field of Classification Search
CPC ..... B25G 1/085; B25B 15/04; B25B 21/00; B25B 23/0035; B25B 23/12; B25B 23/18
See application file for complete search history.

(56) References Cited

U.S. PATENT DOCUMENTS 4,404,877 A 9/1983 Mizuno et al.
7,237,458 B2 * 7/2007 Shiao ..... B25B 13/463 81/62
(Continued)

FOREIGN PATENT DOCUMENTS

CN 201960512 9/2011
CN 202684810 1/2013
(Continued)

*Primary Examiner* — Robert J Scruggs
(74) *Attorney, Agent, or Firm* — Muncy, Geissler, Olds & Lowe, P.C.

(57) ABSTRACT

A push-pull bit detaching and mounting tool including a casing is described herein. A ratchet wheel seat having a conveying passage is disposed at an end portion of the casing. A ratchet wheel head having bit mounting holes is disposed on the ratchet wheel seat. A ratchet wheel control mechanism is disposed between the ratchet wheel head and the ratchet wheel seat. An accommodating groove is formed on the casing. A bit storage seat is disposed in the accommodating groove. A plurality of storage holes are formed on the bit storage seat in the circumferential direction. A positioning structure is disposed between the bit storage seat and the accommodating groove. The casing has a mounting seat. A push-pull rod having a first permanent magnet at an end portion is disposed on the mounting seat, and an axial positioning mechanism is disposed between the push-pull rod and the mounting seat.

10 Claims, 2 Drawing Sheets

(51) Int. Cl.

| | |
|---|---|
| ***B25B 23/18*** | (2006.01) |
| ***B25B 15/04*** | (2006.01) |
| ***B25B 23/00*** | (2006.01) |
| ***B25B 23/12*** | (2006.01) |

(52) U.S. Cl.
CPC ..... *B25B 23/0035* (2013.01); *B25B 23/12* (2013.01); *B25B 23/18* (2013.01)

(56) References Cited

U.S. PATENT DOCUMENTS

| | | | | |
|---|---|---|---|---|
| 2008/0190249 | A1 | 8/2008 | Yu | |
| 2013/0032368 | A1 | 2/2013 | Zhang et al. | |
| 2014/0329654 | A1* | 11/2014 | Andriolo ..... | B25F 5/029 483/1 |

FOREIGN PATENT DOCUMENTS

| | | |
|---|---|---|
| CN | 204183484 | 3/2015 |
| TW | 200514663 | 5/2005 |
| TW | I236402 | 7/2005 |

* cited by examiner

PUSH-PULL BIT DETACHING AND MOUNTING TOOL

The application claims the priority of the following Chinese patent application of the applicant: Chinese Application No. 201410581397.8, filed on Oct. 28, 2014 and entitled "PUSH-PULL BIT DETACHING AND MOUNTING TOOL".

TECHNICAL FIELD

The present invention belongs to the technical field of mechanical apparatus, relates to a detaching and mounting tool, and particularly relates to a push-pull bit detaching and mounting tool.

BACKGROUND

A detaching and mounting tool is extensively used in daily life and is mainly used for detaching or mounting fasteners. For example, a common screwdriver is a screw loosening and fastening tool. For the screwdriver, a variety of screwdriver bits are needed since there are a variety of screws, and thus a multipurpose screwdriver is designed. The conventional multipurpose screwdriver is formed by bits and a handle. When in use, the bits which are needed are respectively mounted and fixed in the handle for use, but when the bit need to be changed, it needs to be dismounted and another bit needs to be mounted in for use. In this way, every time the bits are changed, it is inevitable to repeat the steps of dismounting, placing, matching and mounting, thusly the changing process is complicated and the efficiency is low. In addition, the detached bit is inconvenient to store and is easy to lose, which brings large inconvenience for the use of the screwdriver.

In order to solve the problems in the prior art, people carry out long-term exploration and propose a variety of solutions. For example, one of prior art discloses a novel combination screwdriver. Wherein, a screwdriver bit fixing pipe is fixed at the front end of the handle thereof. A rotating wheel is rotatably disposed in a groove on the front side of the handle through a rotating shaft. A plurality of screwdriver bit accommodating holes are uniformly formed on the rotating wheel. Screwdriver bits are disposed in the screwdriver bit accommodating holes. A push rod coaxial with the screwdriver bit fixing pipe is horizontally and movably disposed at the upper part of the handle. Magnets matching with the front end of the push rod are disposed at the tail ends of the screwdriver bits.

The above solution solves a part of problems in the prior art to a certain extent. For example, the problem of storage inconvenience of the bits, namely, the bits are disposed in the rotating wheel, the bits are changed by rotating the rotating wheel, and the push rod pushes out the bits to the screwdriver bit fixing pipe to achieve the change process. However the following technical problems are still exist in the solution: the switch operation is inconvenient, the accommodating holes are difficult to be aligned with the screwdriver bit fixing pipe, when being disposed in the screwdriver bit fixing pipe, the bits are not positioned fastenedly and easy to have a retraction, so that improvement is necessary.

SUMMARY

Technical Problem

In view of the above problems, the purpose of the present invention is to provide a push-pull bit detaching and mounting tool, which is reasonable in design and is convenient to change bits.

Solution of the Problem

To fulfill the above purpose, embodiments of the present invention adopt the following technical solutions. The push-pull bit detaching and mounting tool includes a casing. A ratchet wheel seat having a conveying passage may be disposed at an end portion of the casing. A ratchet wheel head having bit mounting holes communicated with the conveying passage may be disposed on the ratchet wheel seat. A ratchet wheel control mechanism used for controlling the circumferential rotation direction of the ratchet wheel head and/or locking the ratchet wheel head in the circumferential direction may be disposed between the ratchet wheel head and the ratchet wheel seat. An accommodating groove is formed on the casing. A bit storage seat capable of rotating in the circumferential direction is disposed in the accommodating groove through a mounting structure. A plurality of storage holes formed along the axial direction of the bit storage seat and used for storing bits are formed on the bit storage seat in the circumferential direction. A positioning structure, which can align any one storage hole with the conveying passage when the bit storage seat rotates in the circumferential direction, is disposed between the bit storage seat and the accommodating groove. A mounting seat is disposed at a position located at a back end of the accommodating groove on the casing. A push-pull rod is disposed on the mounting seat in an axial sliding manner through guide structure. A first permanent magnet is disposed at the end portion of the push-pull rod. The push-pull rod can push out the bits in the storage holes to the bit mounting holes and return the bits in the bit mounting holes into the storage holes, and an axial positioning mechanism, used for driving the push-pull rod to axially slide and axially positioning the push-pull rod on the mounting seat when the bits are in the bit mounting holes, is disposed between the push-pull rod and the mounting seat.

In the structure, a plurality of bits may be disposed in the bit storage seat. When the bit storage seat is rotated, the positioning mechanism may align the storage holes with the conveying passage, the bits may be deviated from the storage holes until arriving at the bit mounting holes by means of the axial sliding of the push-pull rod, or the bits in the bit mounting holes may be returned into the storage holes through the first permanent magnet. When the bits are in the bit mounting holes, the axial positioning mechanism axially positions the push-pull rod to prevent the bits from easily retracting when in use, so as to achieve the entire change process, and the bits are convenient to change. In addition, when in use, the bits may be unidirectionally rotated or circumferentially locked by the ratchet wheel control mechanism, so that the detaching and mounting tool is more convenient to use.

In the above-mentioned push-pull bit detaching and mounting tool, the axial positioning mechanism may include a sliding push block disposed on the mounting seat through a sliding guide structure and capable of axially sliding. A plurality of positioning slots may be formed in the end portion of the push-pull rod. A plurality of positioning pins plugged and connected in the positioning slots in a one-to-one correspondence manner may be disposed on an inner side of the sliding push block. Two locking blocks, disposed oppositely and obliquely and respectively located on two sides of the end portion of the push-pull rod, may be hinged on the mounting seat. Elastic structure capable of driving the two locking blocks to mutually approach may be disposed between the locking blocks and the mounting seat. The two sides of the end portion of the push-pull rod may be respectively abutting in locking notches on the inner sides of the two locking blocks. A pushing structure capable of driving the two locking blocks to mutually depart when the sliding push block axially slides may be disposed on the sliding push block. Apparently, the locking blocks may mutually approach under the action of the elastic structure, and the push-pull rod may be abutted in the locking notches to be axially positioned. When the sliding push block axially slides, the pushing structure may drive the two locking blocks to mutually depart, so as to deviate the push-pull rod from the locking notches to remove the axial positioning of the push-pull rod.

In the above-mentioned push-pull bit detaching and mounting tool, the pushing structure may include locking plates respectively disposed on the outer sides of the locking blocks. Two guide plates, disposed to be parallel to each other and respectively located on two sides of the positioning pins, may be disposed on the inner side of the sliding push block, oblique push plates one-to-one corresponding to the locking plates may be respectively disposed on end portions close to the positioning pins of the two guide plates. The two oblique push plates may be disposed oppositely and obliquely, and the outer sides of the end portions of the oblique push plates may abut against the inner sides of the end portions of the locking plates. Namely, the oblique push plates may push the locking plates to separate the two locking blocks. In addition, after the oblique push plates are away from the locking blocks, the outer sides of the guide plates may abut against the inner sides of the locking plates, so that the two locking blocks may be at a mutually separate state, which is conducive to the axial sliding of the push-pull rod.

In the above-mentioned push-pull bit detaching and mounting tool, the elastic structure may include two limiting grooves formed in the mounting seat. Slide blocks disposed in the limiting grooves in a sliding manner may be disposed on the locking blocks, and jacking pressure springs abutting against the slide blocks may be disposed in the limiting grooves. The sliding guide structure may include two guide grooves axially formed in an outer side of the mounting seat. Guide clamping plates may be respectively disposed on two sides of the sliding push block, and the guide clamping plates may be disposed in the guide grooves in a sliding manner. Namely, when the locking plates are respectively deviated from the guide plates and the oblique push plates, under the action of the jacking pressure springs, the two locking blocks may mutually approach.

In the above-mentioned push-pull bit detaching and mounting tool, the guide structure may further include a guide seat disposed on the mounting seat. A guide hole may be formed in the axial direction of the guide seat, and the push-pull rod may be disposed in the guide hole in a sliding manner, which is conducive to the axial sliding of the push-pull rod.

In the above-mentioned push-pull bit detaching and mounting tool, the mounting structure may include a fixing seat disposed at the end portion of the mounting seat and extending downwards. The fixing seat and the ratchet wheel seat form the above-mentioned accommodating groove. A first accommodating hole may be formed in the center of one end of the bit storage seat. A first ball may be disposed at the end portion of the first accommodating hole. A mounting groove matching with the first ball may be formed in a position located below the conveying passage on the ratchet wheel seat. A first spring capable of exposing the first ball from the first accommodating hole and abutting in the mounting groove may be disposed in the first accommodating hole. A second permanent magnet may be disposed at the center of the other end of the bit storage seat. A cooperating iron block corresponding to the second permanent magnet may be disposed on the fixing seat. Therefore, one end of the bit storage seat may abut in the mounting groove through the first ball to be positioned, and the other end of the bit storage seat may be positioned by the mutual attraction of the second permanent magnet and the cooperating iron block. In addition, to conveniently rotate the bit storage seat, a hand hole may be formed in the bottom of the accommodating groove. In this way, the bit storage seat is easy to rotate in the circumferential direction and is convenient to dismount.

In the above-mentioned push-pull bit detaching and mounting tool, the positioning structure may include a plurality of positioning slots uniformly formed in the circumferential edge of the end portion of the bit storage seat. The number of the positioning slots may be equal to the number of the storage holes. The positioning slots and the storage holes may be disposed in a one-to-one staggering manner. Two second accommodating holes may be formed on the fixing seat. Second balls may be disposed in the second accommodating holes. A cover plate may be disposed on the fixing seat through a fastener. Two through holes one-to-one corresponding to the second accommodating holes may be formed on the cover plate. Second springs capable of exposing the second balls from the through holes and abutting in the positioning slots may be disposed in the second accommodating holes. Preferably, there may be respectively six positioning slots and storage holes herein, which may be uniformly formed in the one-to-one staggering manner. Wherein two mutually disposed positioning slots may be located on the same straight line. When the bit storage seat is rotated in the circumferential direction, the second balls may enter the positioning slots to fulfill automatic alignment of the storage holes with the conveying passage.

In the above-mentioned push-pull bit detaching and mounting tool, the ratchet wheel control mechanism may include an adjusting ring sleeved on the ratchet wheel seat in a circumferential rotating manner. A pillow-shaped body may be disposed at a position located on the outer side of the adjusting ring on the ratchet wheel seat. Two pressure spring holes located below the pillow-shaped body may be formed on the ratchet wheel seat. Pressure springs abutting against the end portion of the pillow-shaped body may be respectively disposed in the pressure spring holes. A pressing sheet may be fixed on the adjusting ring. The end portion of the pressing sheet may be pressed above the middle part of the pillow-shaped body. The ratchet wheel head may be connected with the ratchet wheel seat through a connecting structure. A plurality of ratchets may be disposed on the circumferential inner side of the ratchet wheel head, and cooperating portions mutually engaged with the ratchets may be respectively disposed at both ends of the pillow-shaped body. In the structure, by means of the lever principle, the adjusting ring may be rotated to enable the pressing sheet to press the middle part or any end of the pillow-shaped body. When the pressing sheet is pressed on the middle part of the pillow-shaped body, the pillow-shaped body may be at a balanced state, and the cooperating portions on both ends may be mutually engaged with the ratchets to lock the ratchet wheel head in the circumferential direction. When the pressing sheet is pressed on any end of the pillow-shaped body, the balance of the pillow-shaped body may be broken. The end abutting against the pressing sheet of the pillow-shaped body may move downwards. The cooperating portion at the other end may be continuously engaged with the ratchets to achieve the unidirectional rotation of the ratchet wheel head.

In the above-mentioned push-pull bit detaching and mounting tool, the connecting structure may include an annular groove formed in the end portion of the ratchet wheel seat. The ratchet wheel head may be sleeved on the ratchet wheel seat in a circumferential rotating manner. An opening clamp ring capable of axially positioning the ratchet wheel head may be clamped in the annular groove. Namely, the ratchet wheel head may be connected with the ratchet wheel seat through the opening clamp ring to prevent the both from easily deviating from each other.

In the above-mentioned push-pull bit detaching and mounting tool, the casing may be gun-shaped and formed by splicing two half casings. A light emitting diode (LED) lamp facing to the ratchet wheel head may be disposed on the lower side of the casing. The LED lamp may be connected with a built-in power supply disposed in the casing. A switch located on the casing may be disposed between the built-in power supply and the LED lamp. Preferably, the switch herein may be disposed at a trigger position of the gun-shaped casing, namely, the LED lamp may be turned on or turned off by pulling the trigger, and in this way, the detaching and mounting tool may be normally used even if in a dark environment.

Beneficial Effects of the Present Invention

Compared with the prior art, the preferred embodiments of the push-pull bit detaching and mounting tool have the advantages as below. The design is reasonable. The structure is simple. The bits are convenient to store. The bits are convenient and simple to change. The bits can be automatically aligned with the mounting holes. When in use, the bits are firmly positioned and are unlikely to retract. The stability is high. The push-pull bit detaching and mounting tool has an illumination function, which can be normally used even if in the dark environment.

BRIEF DESCRIPTION OF THE DRAWINGS

In FIG. 1 to FIG. 4, related reference symbols are as follows: casing 1, accommodating groove 11, half casing 12, LED lamp 13, built-in power supply 14, switch 15, ratchet wheel seat 2, conveying passage 21, ratchet wheel head 3, bit mounting hole 31, ratchet wheel control mechanism 4, adjusting ring 41, pillow-shaped body 42, pressure spring hole 43, pressure spring 44, pressing sheet 45, ratchet 46, annular groove 47, opening clamp ring 48, mounting structure 5, fixing seat 51, first accommodating hole 52, first ball 53, mounting groove 54, first spring 55, second permanent magnet 56, bit storage seat 6, storage hole 61, positioning structure 7, positioning slot 71, second accommodating hole 72, second ball 73, cover plate 74, through hole 75, second spring 76, mounting seat 8, axial positioning mechanism 81, sliding push block 811, positioning groove 812, positioning pin 813, locking block 814, locking notch 815, locking plate 816, guide plate 817, oblique push plate 818, limiting groove 82, slide block 83, jacking pressure spring 84, guide groove 85, guide clamping plate 86, guide seat 87, guide hole 88, push-pull rod 9, and first permanent magnet 91.

DETAILED DESCRIPTION

Figure 1:
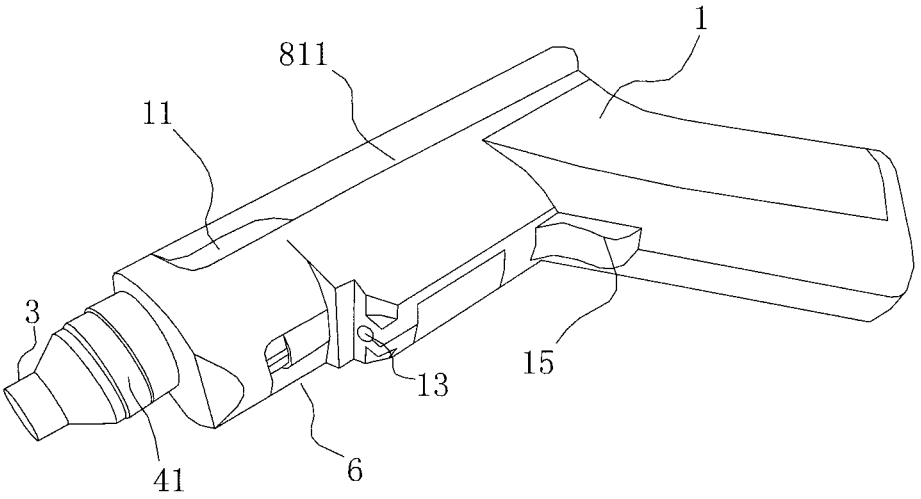
FIG. 1 is a schematic diagram of a structure of a push-pull bit detaching and mounting tool provided in an embodiment of the present invention.

A further detailed illustration of the present invention will be given below in combination with the accompanying drawings and specific implementations.

As shown in FIG. 1 to FIG. 4, the push-pull bit detaching and mounting tool includes a casing 1. A ratchet wheel seat 2 having a conveying passage 21 is disposed at an end portion of the casing 1. A ratchet wheel head 3 having bit mounting holes 31 communicated with the conveying passage 21 is disposed on the ratchet wheel seat 2. A ratchet wheel control mechanism 4 used for controlling the circumferential rotation direction of the ratchet wheel head 3 and/or locking the ratchet wheel head 3 in the circumferential direction is disposed between the ratchet wheel head 3 and the ratchet wheel seat 2. An accommodating groove 11 is formed on the casing 1. A bit storage seat 6 capable of rotating in the circumferential direction is disposed in the accommodating groove 11 through mounting structure 5. A plurality of storage holes 61 formed along the axial direction of the bit storage seat 6 and used for storing bits are formed on the bit storage seat 6 in the circumferential direction. A positioning structure 7, which can align any one storage hole 61 with the conveying passage 21 when the bit storage seat 6 rotates in the circumferential direction, is disposed between the bit storage seat 6 and the accommodating groove 11. A mounting seat 8 is disposed at a position located at the back end of the accommodating groove 11 on the casing 1. A push-pull rod 9 is disposed on the mounting seat 8 in an axial sliding manner through a guide structure. A first permanent magnet 91 is disposed at an end portion of the push-pull rod 9. The push-pull rod 9 can push out the bits in the storage holes 61 to the bit mounting holes 31 or return the bits in the bit mounting holes 31 into the storage holes 61. An axial positioning mechanism 81, used for driving the push-pull rod 9 to axially slide and axially positioning the push-pull rod 9 on the mounting seat 8 when the bits are in the bit mounting holes 31, is disposed between the push-pull rod 9 and the mounting seat 8. In the structure, a plurality of bits can be accommodated in the bit storage seat 5. When the bit storage seat 5 is rotated, the positioning structure 7 can align the storage holes 61 with the conveying passage 21. The bits are deviated from the storage holes 61 until arriving at the bit mounting holes 31 by means of the axial sliding of the push-pull rod 9, or the bits in the bit mounting holes 31 are returned into the storage holes 61 through the first permanent magnet 91. When the bits are in the bit mounting holes 31, the axial positioning mechanism 81 axially positions the push-pull rod 9 to prevent the bits from easily retracting when in use, so as to achieve the entire change process, and the bits are convenient to change. In addition, when in use, the bits may be unidirectionally rotated or circumferentially locked by the ratchet wheel control mechanism 4, so that the detaching and mounting tool is more convenient to use.

Figure 2:
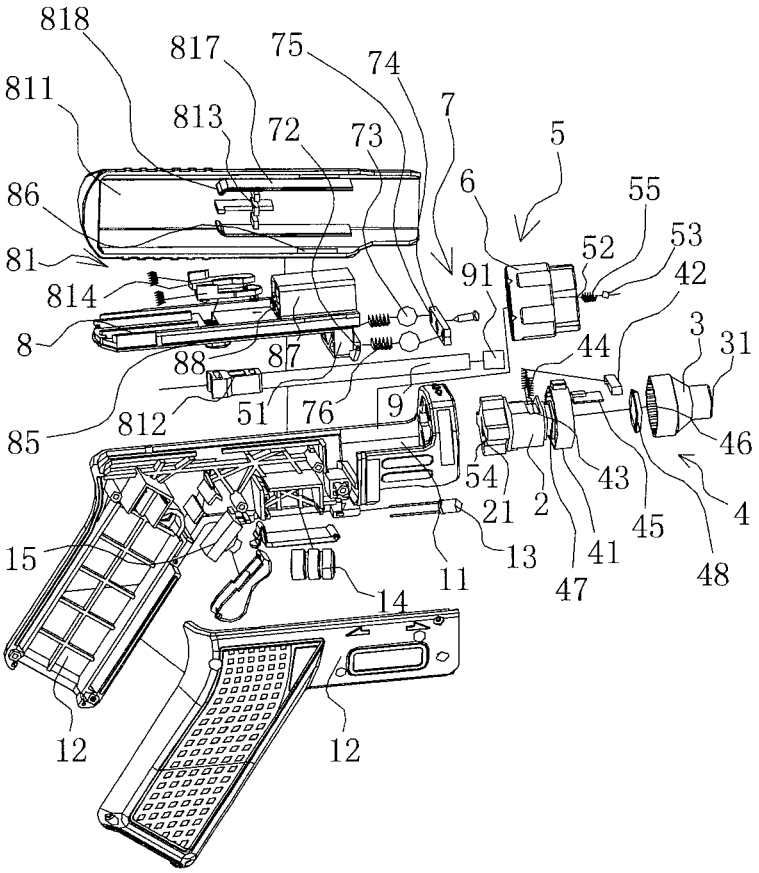
FIG. 2 is an explosive diagram of a push-pull bit detaching and mounting tool provided in an embodiment of the present invention.
Figure 3:
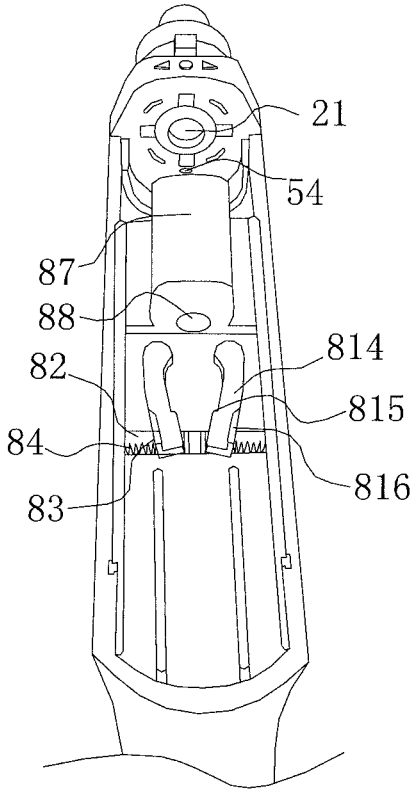
FIG. 3 is a schematic diagram of a partial structure of a push-pull bit detaching and mounting tool provided in an embodiment of the present invention.
Figure 4:
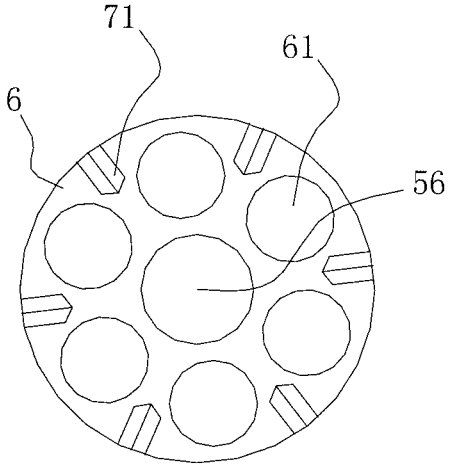
FIG. 4 is a schematic diagram of a structure of a bit storage seat in a push-pull bit detaching and mounting tool provided in an embodiment of the present invention.

As shown in FIG. 2 and FIG. 3, the axial positioning mechanism 81 in the embodiment includes a sliding push block 811, which is disposed on the mounting seat 8 through a sliding guide structure and may axially slide. A plurality of positioning grooves 812 are formed in the end portion of the push-pull rod 9. A plurality of positioning pins 813 plugged and connected in the positioning grooves 812 in a one-to-one correspondence manner are disposed on an inner side of the sliding push block 811. Two locking blocks 814, which are disposed oppositely and obliquely and are respectively located on two sides of the end portion of the push-pull rod 9, are hinged on the mounting seat 8. Elastic structure capable of driving the two locking blocks 814 to mutually approach is disposed between the locking block 814 on each side and the mounting seat 8. The two sides of the end portion of the push-pull rod 9 respectively abut in locking notches 815 on the inner sides of the two locking blocks 814, and pushing structure capable of driving the two locking blocks 814 to mutually depart when the sliding push block 811 axially slides is disposed on the sliding push block 811. In this way, the locking blocks 814 mutually approach under the action of the elastic structure, and the push-pull rod 9 abuts in the locking notches 815 to be axially positioned. When the sliding push block 811 axially slides, the pushing structure drives the two locking blocks 814 to mutually depart, so as to deviate the push-pull rod 9 from the locking notches 815 to remove the axial positioning of the push-pull rod 9.

Wherein, the pushing structure herein includes locking plates 816 which are respectively disposed on the outer sides of the locking blocks 814. Two guide plates 817, which are disposed to be parallel to each other and are respectively located on two sides of the positioning pins 813, are disposed on the inner side of the sliding push block 811. Oblique push plates 818 one-to-one corresponding to the locking plates 816 are respectively disposed on end portions close to the positioning pins 813 of the two guide plates 817. The two oblique push plates 818 are disposed oppositely and obliquely, and the outer sides of the end portions of the oblique push plates 818 abut against the inner sides of the end portions of the locking plates 816. In this case, the oblique push plates 818 push the locking plates 816 to separate the two locking blocks 814. In addition, after the oblique push plates 818 are away from the locking plates 816, the outer sides of the guide plates 817 abut against the inner sides of the locking plates 816, so that the two locking blocks 814 are at a mutually separate state, which is conducive to the axial sliding of the push-pull rod 9.

The elastic structure herein includes two limiting grooves 82 formed in the mounting seat 8. Slide blocks 83 disposed in the limiting grooves 82 in a sliding manner are disposed on the locking blocks 814. Jacking pressure springs 84 abutting against the slide blocks 83 are disposed in the limiting grooves 82. The sliding guide structure includes two guide grooves 85 which are axially formed in the outer side of the mounting seat 8. Guide clamping plates 86 are respectively disposed on two sides of the sliding push block 811, and the guide clamping plates 86 are disposed in the guide grooves 85 in a sliding manner. Namely, when the locking plates 816 are respectively deviated from the guide plates 817 and the oblique push plates 818, under the action of the jacking pressure springs 84, the two locking blocks 814 mutually approach. To facilitate the axial sliding of the push-pull rod 9, the guide structure therein includes a guide seat 87 disposed on the mounting seat 8. A guide hole 88 is formed in the axial direction of the guide seat 87. The push-pull rod 9 is disposed in the guide hole 88 in a sliding manner to guarantee the push-pull rod 9 to slide along the axial direction.

Further, the mounting structure 5 in the embodiment includes a fixing seat 51 which is disposed at the end portion of the mounting seat 8 and extends downwards. The fixing seat 51 and the ratchet wheel seat 2 form the above-mentioned accommodating groove 11. A first accommodating hole 52 is formed in the center of one end of the bit storage seat 6. A first ball 53 is disposed at the end portion of the first accommodating hole 52. A mounting groove 54 matching with the first ball 53 is formed in a position located below the conveying passage 21 on the ratchet wheel seat 2. A first spring 55 capable of exposing the first ball 53 from the first accommodating hole 52 and abutting in the mounting groove 54 is disposed in the first accommodating hole 52. A second permanent magnet 56 is disposed at the center of the other end of the bit storage seat 6. A cooperating iron block corresponding to the second permanent magnet 56 is disposed on the fixing seat 51. Therefore, one end of the bit storage seat 6 abuts in the mounting groove 54 through the first ball 53 to be positioned, and the other end of the bit storage seat is positioned by the mutual attraction of the second permanent magnet 56 and the cooperating iron block. In addition, to conveniently rotate the bit storage seat 6, a hand hole is formed in the bottom of the accommodating groove 11. In this way, the bit storage seat 6 is easy to rotate in the circumferential direction and is convenient to detach. Preferably, the positioning structure 7 herein includes a plurality of positioning slots 71 which are uniformly formed in the circumferential edge of the end portion of the bit storage seat 6. The number of the positioning slots 71 is equal to the number of the storage holes 61. The positioning slots 71 and the storage holes 61 are disposed in a one-to-one staggering manner. Two second accommodating holes 72 are formed on the fixing seat 51, and second balls 73 are disposed in the second accommodating holes 72. A cover plate 74 is disposed on the fixing seat 51 through a fastener. Two through holes 75 one-to-one corresponding to the second accommodating holes 72 are formed on the cover plate 74. Second springs 76 capable of exposing the second balls 73 from the through holes 75 and abutting in the positioning slots 71 are disposed in the second accommodating holes 72. Preferably, there are respectively six positioning slots 71 and six storage holes 61 herein, which are uniformly formed in the one-to-one staggering manner. Two mutually disposed positioning slots 71 are located on the same straight line. When the bit storage seat 6 is rotated in the circumferential direction, the second balls 73 enter the positioning slots 71 to fulfill automatic alignment of the storage holes 61 with the conveying passage 21.

Further, the ratchet wheel control mechanism 4 herein includes an adjusting ring 41 sleeved on the ratchet wheel seat 2 in a circumferential rotating manner. A pillow-shaped body 42 is disposed at a position located on the outer side of the adjusting ring 41 on the ratchet wheel seat 2. Two pressure spring holes 43 located below the pillow-shaped body 42 are formed on the ratchet wheel seat 2. Pressure springs 44 abutting against the end portion of the pillow-shaped body 42 are respectively disposed in the pressure spring holes 43. In addition, a pressing sheet 45 is fixed on the adjusting ring 41. The end portion of the pressing sheet 45 is pressed above the middle part of the pillow-shaped body 42. The ratchet wheel head 3 is connected with the ratchet wheel seat 2 through connecting structure. A plurality of ratchets 46 are disposed on the circumferential inner side of the ratchet wheel head 3. Cooperating portions mutually engaged with the ratchets 46 are respectively disposed at both ends of the pillow-shaped body 42. Therefore, by means of the lever principle, the adjusting ring 41 is rotated to enable the pressing sheet 45 to press the middle part or any end of the pillow-shaped body 42. When the pressing sheet 45 is pressed on the middle part of the pillow-shaped body 42, the pillow-shaped body 42 is at a balanced state, and the cooperating portions on both ends are mutually engaged with the ratchets 46 to lock the ratchet wheel head 3 in the circumferential direction. When the pressing sheet 45 is pressed on any end of the pillow-shaped body 42, the balance of the pillow-shaped body 42 is broken. The end abutting against the pressing sheet 45 of the pillow-shaped body moves downwards. The cooperating portion at the other end is continuously engaged with the ratchets 46 to achieve the unidirectional rotation of the ratchet wheel head 3.

Wherein, the connecting structure herein includes an annular groove 47 formed in the end portion of the ratchet wheel seat 2. The ratchet wheel head 3 is sleeved on the ratchet wheel seat 2 in a circumferential rotating manner. An opening clamp ring 48 capable of axially positioning the ratchet wheel head 3 is clamped in the annular groove 47. Namely, the ratchet wheel head 3 is connected with the ratchet wheel seat 2 through the opening clamp ring 48 to prevent the both from easily deviating from each other. In addition, the casing 1 herein is gun-shaped and is formed by splicing two half casings 12. a light emitting diode (LED) lamp 13 facing to the ratchet wheel head 3 is disposed on the lower side of the casing 1. The LED lamp 13 is connected with a built-in power supply 14 disposed in the casing 1. A switch 15 located on the casing 1 is disposed between the built-in power supply 14 and the LED lamp 13. Preferably, the switch 15 herein is disposed at a trigger position of the gun-shaped casing 1. Namely, the LED lamp 13 is turned on or turned off by pulling the trigger. In this way, the detaching and mounting tool can be normally used even if in a dark environment.

The specific embodiments described in this paper are merely exemplary illustration to the spirit of the present invention. Those skilled in the art to which the present invention pertains may make a variety of modifications, supplements or replacements in similar manners on the described specific embodiments, but these modifications, supplements or replacements do not deviate from the spirit of the present invention or exceed the scope defined by the appended claims.

Furthermore, although these terms in this paper are used for describing the structures and components involved in the embodiments of the present invention, the possibility of using other terms is not excluded. For example, the casing 1, the accommodating groove 11, the half casing 12, the LED lamp 13, the built-in power supply 14, the switch 15, the ratchet wheel seat 2, the conveying passage 21, the ratchet wheel head 3, the bit mounting hole 31, the ratchet wheel control mechanism 4, the adjusting ring 41, the pillow-shaped body 42, the pressure spring hole 43, the pressure spring 44, the pressing sheet 45, the ratchet 46, the annular groove 47, the opening clamp ring 48, the mounting structure 5, the fixing seat 51, the first accommodating hole 52, the first ball 53, the mounting groove 54, the first spring 55, the second permanent magnet 56, the bit storage seat 6, the storage hole 61, the positioning structure 7, the positioning slot 71, the second accommodating hole 72, the second ball 73, the cover plate 74, the through hole 75, the second spring 76, the mounting seat 8, the axial positioning mechanism 81, the sliding push block 811, the positioning groove 812, the positioning pin 813, the locking block 814, the locking notch 815, the locking plate 816, the guide plate 817, the oblique push plate 818, the limiting groove 82, the slide block 83, the jacking pressure spring 84, the guide groove 85, the guide clamping plate 86, the guide seat 87, the guide hole 88, the push-pull rod 9, the first permanent magnet 91, etc. These terms are merely used for describing and explaining the essence of the present invention more conveniently, and explanation of these terms as any additional limitation is contrary to the spirit of the present invention.

What is claimed is:

1. A push-pull bit detaching and mounting tool, comprising a casing, wherein an accommodating groove is formed on the casing, a bit storage seat capable of rotating in a circumferential direction is disposed in the accommodating groove through mounting structure, a plurality of storage holes formed along an axial direction of the bit storage seat and used for storing bits are formed on the bit storage seat in the circumferential direction, and positioning structure, capable of aligning any one storage hole with a conveying passage when the bit storage seat rotates in the circumferential direction, is disposed between the bit storage seat and the accommodating groove, wherein a mounting seat is disposed at a position located at a back end of the accommodating groove on the casing, a push-pull rod is disposed on the mounting seat in an axial sliding manner through guide structure, a first permanent magnet is disposed at an end portion of the push-pull rod, the push-pull rod is capable of pushing out the bits in storage holes to bit mounting holes and return the bits in the bit mounting holes into the storage holes, and an axial positioning mechanism, used for driving the push-pull rod to axially slide and axially positioning the push-pull rod on the mounting seat when the bits are in the bit mounting holes, is disposed between the push-pull rod and the mounting seat;

wherein the axial positioning mechanism comprises a sliding push block disposed on the mounting seat through sliding guide structure and capable of axially sliding, a plurality of positioning grooves are formed in the end portion of the push-pull rod, a plurality of positioning pins plugged and connected in the positioning grooves in a one-to-one correspondence manner are disposed on an inner side of the sliding push block, two locking blocks, disposed oppositely and obliquely and respectively located on two sides of the end portion of the push-pull rod, are hinged on the mounting seat, elastic structure capable of driving the two locking blocks to mutually approach is disposed between the locking blocks and the mounting seat, two sides of the end portion of the push-pull rod respectively abut in locking notches on the inner sides of the two locking blocks, and pushing structure capable of driving the two locking blocks to mutually depart when the sliding push block axially slides is disposed on the sliding push block.

2. The push-pull bit detaching and mounting tool according to claim 1, wherein the pushing structure comprises locking plates respectively disposed on the outer sides of the locking blocks, two guide plates, disposed to be parallel to each other and respectively located on two sides of the positioning pins, are disposed on the inner side of the sliding push block, oblique push plates one-to-one corresponding to the locking plates are respectively disposed on end portions close to the positioning pins of the two guide plates, the two oblique push plates are disposed oppositely and obliquely, and the outer sides of the end portions of the oblique push plates abut against the inner sides of end portions of the locking plates.

3. The push-pull bit detaching and mounting tool according to claim 2, wherein the guide structure further comprises a guide seat disposed on the mounting seat, a guide hole is formed in the axial direction of the guide seat, and the push-pull rod is disposed in the guide hole in a sliding manner.

4. The push-pull bit detaching and mounting tool according to claim 1, wherein the elastic structure comprises two limiting grooves disposed in the mounting seat, slide blocks disposed in the limiting grooves in a sliding manner are disposed on the locking blocks, and jacking pressure springs abutting against the slide blocks are disposed in the limiting grooves; the sliding guide structure comprises two guide grooves axially formed in an outer side of the mounting seat, guide clamping plates are respectively disposed on two sides of the sliding push block, and the guide clamping plates are disposed in the guide grooves in a sliding manner.

5. The push-pull bit detaching and mounting tool according to claim 4, wherein the guide structure further comprises a guide seat disposed on the mounting seat, a guide hole is formed in the axial direction of the guide seat, and the push-pull rod is disposed in the guide hole in a sliding manner.

6. The push-pull bit detaching and mounting tool according to claim 1, wherein the guide structure further comprises a guide seat disposed on the mounting seat, a guide hole is formed in the axial direction of the guide seat, and the push-pull rod is disposed in the guide hole in a sliding manner.

7. A push-pull bit detaching and mounting tool, comprising a casing, wherein an accommodating groove is formed on the casing, a bit storage seat capable of rotating in a circumferential direction is disposed in the accommodating groove through mounting structure, a plurality of storage holes formed along an axial direction of the bit storage seat and used for storing bits are formed on the bit storage seat in the circumferential direction, and positioning structure, capable of aligning any one storage hole with a conveying passage when the bit storage seat rotates in the circumferential direction, is disposed between the bit storage seat and the accommodating groove, wherein a mounting seat is disposed at a position located at a back end of the accommodating groove on the casing, a push-pull rod is disposed on the mounting seat in an axial sliding manner through guide structure, a first permanent magnet is disposed at an end portion of the push-pull rod, the push-pull rod is capable of pushing out the bits in storage holes to bit mounting holes and return the bits in the bit mounting holes into the storage holes, and an axial positioning mechanism, used for driving the push-pull rod to axially slide and axially positioning the push-pull rod on the mounting seat when the bits are in the bit mounting holes, is disposed between the push-pull rod and the mounting seat;

wherein the guide structure further comprises a guide seat disposed on the mounting seat, a guide hole is formed in the axial direction of the guide seat, and the push-pull rod is disposed in the guide hole in a sliding manner;

wherein the mounting structure comprises a fixing seat disposed at an end portion of the mounting seat and extending downwards, the fixing seat and a ratchet wheel seat form the accommodating groove, a first accommodating hole is formed in the center of one end of the bit storage seat, a first ball is disposed at an end portion of the first accommodating hole, a mounting groove matching with the first ball is formed in a position located below the conveying passage on the ratchet wheel seat, a first spring capable of exposing the first ball from the first accommodating hole and abutting in the mounting groove is disposed in the first accommodating hole, a second permanent magnet is disposed at the center of the other end of the bit storage seat, and a cooperating iron block corresponding to the second permanent magnet is disposed on the fixing seat.

8. The push-pull bit detaching and mounting tool according to claim 7, wherein the positioning structure comprises a plurality of positioning slots uniformly formed in the circumferential edge of the end portion of the bit storage seat, the number of the positioning slots is equal to the number of the storage holes, the positioning slots and the storage holes are disposed in a one-to-one staggering manner, two second accommodating holes are formed on the fixing seat, second balls are disposed in the second accommodating holes, a cover plate is disposed on the fixing seat through a fastener, two through holes one-to-one corresponding to the second accommodating holes are formed on the cover plate, and second springs capable of exposing the second balls from the through holes and abutting in the positioning slots are disposed in the second accommodating holes.

9. A push-pull bit detaching and mounting tool, comprising a casing, wherein an accommodating groove is formed on the casing, a bit storage seat capable of rotating in a circumferential direction is disposed in the accommodating groove through mounting structure, a plurality of storage holes formed along an axial direction of the bit storage seat and used for storing bits are formed on the bit storage seat in the circumferential direction, and positioning structure, capable of aligning any one storage hole with a conveying passage when the bit storage seat rotates in the circumferential direction, is disposed between the bit storage seat and the accommodating groove, wherein a mounting seat is disposed at a position located at a back end of the accommodating groove on the casing, a push-pull rod is disposed on the mounting seat in an axial sliding manner through guide structure, a first permanent magnet is disposed at an end portion of the push-pull rod, the push-pull rod is capable of pushing out the bits in storage holes to bit mounting holes and return the bits in the bit mounting holes into the storage holes, and an axial positioning mechanism, used for driving the push-pull rod to axially slide and axially positioning the push-pull rod on the mounting seat when the bits are in the bit mounting holes, is disposed between the push-pull rod and the mounting seat;

wherein a ratchet wheel seat formed with the conveying passage is disposed at an end portion of the casing, a ratchet wheel head having the bit mounting holes communicated with the conveying passage is disposed on the ratchet wheel seat, a ratchet wheel control mechanism is disposed between the ratchet wheel head and the ratchet wheel seat, and the ratchet wheel control mechanism is used for controlling circumferential rotation direction of the ratchet wheel head and/or locking the ratchet wheel head in the circumferential direction;

wherein the ratchet wheel control mechanism comprises an adjusting ring sleeved on the ratchet wheel seat in a circumferential rotating manner, a pillow-shaped body is disposed at a position located on the outer side of the adjusting ring on the ratchet wheel seat, two pressure spring holes located below the pillow-shaped body are formed on the ratchet wheel seat, pressure springs abutting against an end portion of the pillow-shaped body are respectively disposed in the pressure spring holes, a pressing sheet is fixed on the adjusting ring, an end portion of the pressing sheet is pressed above the middle part of the pillow-shaped body, the ratchet wheel head is connected with the ratchet wheel seat through a connecting structure, a plurality of ratchets are disposed on the circumferential inner side of the ratchet wheel head, and cooperating portions mutually engaged with the ratchets are respectively disposed at two ends of the pillow-shaped body.

10. The push-pull bit detaching and mounting tool according to claim 9, wherein the connecting structure comprises an annular groove formed in an end portion of the ratchet wheel seat, the ratchet wheel head is sleeved on the ratchet wheel seat in a circumferential rotating manner, and an opening clamp ring capable of axially positioning the ratchet wheel head is clamped in the annular groove.

* * * * *